US006053704A

United States Patent [19]

Yamamoto et al.

[11] Patent Number: 6,053,704

[45] Date of Patent: Apr. 25, 2000

[54] CRYOGENIC VACUUM PUMP SYSTEM HAVING A CRYOPANEL AND A HEAT ABSORBING UNIT

[75] Inventors: Hisashi Yamamoto; Tatunori Koizumi, both of Yamanashi-ken, Japan

[73] Assignee: Anelva Corporation, Fuchu, Japan

[21] Appl. No.: 08/959,073

[22] Filed: Oct. 28, 1997

[30] Foreign Application Priority Data

Dec. 27, 1996 [JP] Japan ..... 8-358715

[51] Int. Cl.[7] ..... B01D 8/00; F04B 19/24

[52] U.S. Cl. ..... 417/52; 62/55.5; 417/423.14; 417/901

[58] Field of Search ..... 417/52, 901, 423.14; 62/55.5

[56] References Cited

U.S. PATENT DOCUMENTS

| | | | |
|---|---|---|---|
| 4,121,430 | 10/1978 | Bachler et al. | 62/55.5 |
| 4,219,588 | 8/1980 | Longsworth | 62/55.5 |
| 4,438,632 | 3/1984 | Lessard et al. | 62/55.5 |
| 4,449,373 | 5/1984 | Peterson et al. | 62/55.5 |
| 4,531,372 | 7/1985 | Slabaugh | 62/55.5 |
| 4,535,024 | 8/1985 | Parker | 428/200 |
| 4,691,534 | 9/1987 | Lombardini et al. | 62/55.5 |
| 4,911,353 | 3/1990 | Deakin | 228/183 |
| 5,261,244 | 11/1993 | Lessard et al. | 62/55.5 |
| 5,343,740 | 9/1994 | Myneni | 73/40.7 |
| 5,477,692 | 12/1995 | Myneni et al. | 62/55.5 |
| 5,483,803 | 1/1996 | Matte et al. | 62/55.5 |
| 5,537,833 | 7/1996 | Matte et al. | 62/55.5 |
| 5,548,964 | 8/1996 | Jinbo et al. | 62/55.5 |
| 5,582,017 | 12/1996 | Noji et al. | 62/55.5 |
| 5,782,096 | 7/1998 | Bartlett et al. | 62/55.5 |

OTHER PUBLICATIONS

Electroplating Guide, 1983.

*Primary Examiner*—Charles G. Freay
*Assistant Examiner*—Robert Z. Evora
*Attorney, Agent, or Firm*—Burns, Doane, Swecker & Mathis, LLP

[57] ABSTRACT

A cryogenic vacuum pump system in which a pump out system such as a cryotrap 13, with which gas is subjected to vacuum pump out by condensing or adsorbing said gas on a cryopanel which has been cooled to a very low temperature, is used, and a radiant heat absorbing baffle 18 which has been subjected to a blackening surface treatment is established up stream of, or around, the cryopanel 15. The radiant heat which is absorbed by the radiant heat absorbing baffle is released outside the chamber. The total thermal load on such a cryotrap is greatly reduced.

20 Claims, 5 Drawing Sheets

CRYOGENIC VACUUM PUMP SYSTEM HAVING A CRYOPANEL AND A HEAT ABSORBING UNIT

BACKGROUND OF THE INVENTION

1. Field of the Invention

The present invention concerns a cryogenic vacuum pump system, and in particular it concerns the improvement of a cryogenic vacuum pump system of the capture pump type in which some of the gas or each type of gas is condensed or adsorbed on a panel which has been cooled to a very low temperature, such as a cryotrap or cryopump.

2. Description of Related Art

Conventional cryogenic vacuum pump systems of this type have had the vacuum pump fitted directly to a chamber which is to be subjected to vacuum pump out. A direct cryopump 52 is sometimes fitted to the chamber 51 which is to be subjected to vacuum pump out, as shown in FIG. 3. The cryopump 52 has two stage panels. The first stage panel is cooled down to about 50K to 120K (usually about 80K) in order to condense water gas. The second stage panel is cooled down to lower than 20K to condense nitrogen gas, oxygen gas, argon gas and the like and adsorb hydrogen gas. Or, a direct cryotrap (53–55) and a turbo-molecular pump 56 are attached to the chamber 51 as shown in FIG. 4. In FIG. 4, the cryotrap includes a cooling panel 53 on which the water gas is condensed in a cylindrical container 55 and the cryogenic refrigerator 54 which cools the cooling panel 53 to a very low temperature of 50K to 120K (usually about 80K). The cryotrap is used together with the turbo-molecular pump 56. In FIG. 4, 57 is the auxiliary pump of the turbo-molecular pump 56 and, in FIG. 3 and FIG. 4, 58 is a heating body such as a heater. The heating body 58 is used to heat the vacuum chamber and release the water molecules which are attached to the wall to enable an even lower pressure to be achieved. Alternatively, the heating body 58 is used to heat the substrate in the vacuum chamber to a temperature of from one hundred to a few hundred degrees celsius in a film deposition process, such as sputtering.

Conventionally, a panel on which many kinds of gases are condensed or adsorbed (for example, the cooling panel 53, referred to hereinafter as a cryopanel) has been included in a cryogenic vacuum pump system in which a very low temperature is used, such as the cryopump 52 of FIG. 3 or the cryotrap (only water) of FIG. 4. The surface temperature of the cryopanel must be set to a level at which the many kinds of gases which are to be removed from the vacuum chamber are condensed or adsorbed, set i.e. to a temperature below the saturated vapor pressure temperature. In other words, if the cryopanel is not below this temperature then no vacuum pumping capacity can be realized.

In a conventional cryogenic vacuum pump system, a cryotrap or cryopump, which is furnished with a cryogenic refrigerator which has an adequate cooling capacity to cool the cryopanel to below this temperature under the influence of the effect of the heat which is generated, for example, for heating the substrate, in the chamber which is being subjected to vacuum pump out, has been used.

OBJECTS AND SUMMARY

The thermal load on the cryopanel, which is to say the heating of the cryopanel, is generally determined as being the sum of three types of thermal loading, namely radiant heat from the cryopanel surroundings, thermal conduction due to gas molecules, and the heat of condensation of the gas. These thermal loadings differ according to the construction of the cryogenic vacuum pump system which is being used and the conditions under which it is being used. Of these thermal loadings, the thermal conduction and heat of condensation are not very great since the system is initially at a vacuum environment. On the other hand, thermal radiation from the surroundings depends on the conditions under which the cryogenic vacuum pump system is being used, and it can be from ten to a hundred times greater than the other thermal loading factors.

Generally, the chamber 51 which is to be subjected to vacuum pump out with a cryogenic vacuum pump system is made of a metal such as stainless steel or aluminum. Most recently the surface of these metal materials has in many cases had the microscopic surface roughness reduced in particular, which is to say that it has been provided with a mirror-like finish, in order to reduce the amount of gas which is released from the walls of the chamber 51. When a process which requires a high temperature is carried out inside such a chamber 51, the infrared radiation emitted by the heating body 58 is repeatedly reflected within the mirror surface like chamber and eventually reaches the cryopanel which is inside the cryopump 52 or the cryotrap. Even in those cases where the cryopanel in the cryogenic vacuum pump system is arranged in such a way that it does not receive infrared radiation from the heating body 58 directly, the radiant heat due to the infrared radiation is repeatedly subjected to mirror surface reflection by the walls of the chamber 51 and so reaches the cryopanel. This imposes a very large thermal loading on the cryopanel.

Most recently, the number of applications where a high temperature process such as that described above is required in particular has tended to rise.

On the basis of the facts outlined above, the thermal loading on the cryopanel due to thermal radiation from the surroundings is markedly increased in a conventional cryogenic vacuum pump system. A cryogenic refrigerator which has a large cooling capacity is required on account of this increase in the thermal load. With the conventional cryogenic vacuum pump systems, problems have arisen in that there are disadvantages in respect of the high cost, and in respect of the complicated shape and large size of the apparatus.

A purpose of the present invention is to provide cryogenic vacuum pump systems with which the problems referred to above are resolved and with which the incidence of infrared radiation on the cryopanel is reduced, even in those cases where there is a large amount of infrared radiation within the chamber which is being subjected to vacuum pump out.

Moreover, another aim of the invention is to provide cryogenic vacuum pump systems with which a cryotrap or cryopump in which a cheap cryogenic refrigerator which has a small cooling capacity and which is small size is used can be used.

In one embodiment of the present invention, a cryogenic vacuum pump system has a radiant heat absorbing baffle fitted on the up-stream side from the cryopanel in the flow of gas which is being pumped out, in order to realize the abovementioned aims. The cryogenic vacuum pump system utilizes a cryotrap or cryopump in which the gas is condensed or adsorbed on a cryopanel and vacuum pump out is achieved.

In the embodiment described above, the radiant heat absorbing baffle is fitted between the chamber which is being subjected to vacuum pump out and the cryopanel. The radiant heat absorbing baffle absorbs the infrared radiation which is being radiated onto the cryopanel from the chamber and then releases the heat outside the cryogenic vacuum pump system. The radiant heat absorbing baffle greatly reduces the total thermal loading on the cryopanel inside the cryotrap or cryopump.

A distinguishing feature of the abovementioned embodiment is that the radiant heat absorbing baffle is preferably made with a metal which has good thermal conductivity. The efficiency with which the absorbed heat is released out of the system is increased by raising the conductivity with respect to the heat which has been absorbed by said baffle, and the infrared radiation emissivity of the baffle is reduced.

Another distinguishing feature of the abovementioned embodiment is that the radiant heat absorbing baffle preferably has a surface which has been subjected to a blackening surface treatment. Black chrome plating is especially desirable. The radiant heat absorbance of the baffle is increased by such a surface treatment.

Another feature of the abovementioned embodiment is that the radiant heat absorbing baffle is preferably cooled by means of cooling water. It is possible in this way to release the radiant heat outside the chamber precisely.

Yet another feature of the abovementioned embodiment is that the radiant heat absorbing baffle is cooled by means of a heat exchanger element. It is possible in this way to release the radiant heat outside the chamber precisely.

In another embodiment of the present invention, a cryogenic vacuum pump system has a radiant heat absorbing baffle, which is connected with good thermal contact to a chamber which has good thermal conductivity, which is to be subjected to vacuum pump out established on the upstream side from the cryopanel in the flow of gas which is being pumped out. The heat which is absorbed by the radiant heat absorbing baffle is conducted to the chamber and heat exchange takes place between the walls and the air. The heat which has been absorbed is released out of the cryogenic vacuum pump system in this way. Water cooling of the radiant heat absorbing baffle is not required in those cases where the chamber which is being subjected to vacuum pump out is made of a material such as aluminum which has good thermal conductivity.

In the embodiment described above, the radiant heat absorbing baffle is preferably formed as one with the chamber, and the inner wall surface of the chamber is preferably subjected to a blackening surface treatment. The infrared radiation is absorbed at the inner surface of the walls of the chamber. This is suitable in cases where the amount of infrared radiation is comparatively small.

In another embodiment of the present invention, a cryogenic vacuum pump system has a radiant heat absorbing part which has been subjected to a blackening surface treatment established around the cryopanel. Black chrome plating is preferred for the blackening surface treatment. A "radiant heat absorbing part" is a part which comprises conceptually the execution of a blackening surface treatment on the inner surface of the container in which the cryopanel is housed, or the arrangement of parts which have been subjected to a blackening surface treatment around the cryopanel. Such a cryogenic vacuum pump system does not involve the use of a radiant heat absorbing baffle with which the radiant heat is shielded from the panel. It is suitable in those cases where the amount of infrared radiation is comparatively small.

In the embodiment described above, the radiant heat absorbing part is preferably the inner surface of the chamber, which is to say the nipple, in which the cryopanel is installed.

In the embodiment described above, the cryopanel is preferably subjected to a surface treatment which reduces its thermal absorption properties. Lustrous nickel plating is especially desirable.

As is clear from the description above, the following effects may result from the present invention.

Because a radiant heat absorbing baffle is established on the upstream side from the cryopanel in a cryotrap or cryopump, the radiant heat which is radiated from the chamber which is being subjected to vacuum pump out onto the cryopanel is absorbed with a high probability by the baffle. The effect of the radiant heat on the cryopanel is reduced and so the thermal loading on the cryopanel is reduced. Hence, a cheap cryogenic refrigerator of low cooling capacity and small size can be used to cool the cryopanel.

A radiant heat absorbing part may be established using a blackening surface treatment around the cryopanel, and so the radiant heat which impinges on the cryopanel is absorbed with a high probability by this radiant heat absorbing part. This is especially suitable in cases where the amount of radiant heat which is being generated is comparatively small and the thermal load on the cryopanel can be reduced.

DETAILED DESCRIPTION OF THE PREFERRED EMBODIMENTS

Preferred embodiments of the present invention are described below with reference to the drawings.

Figure 1:
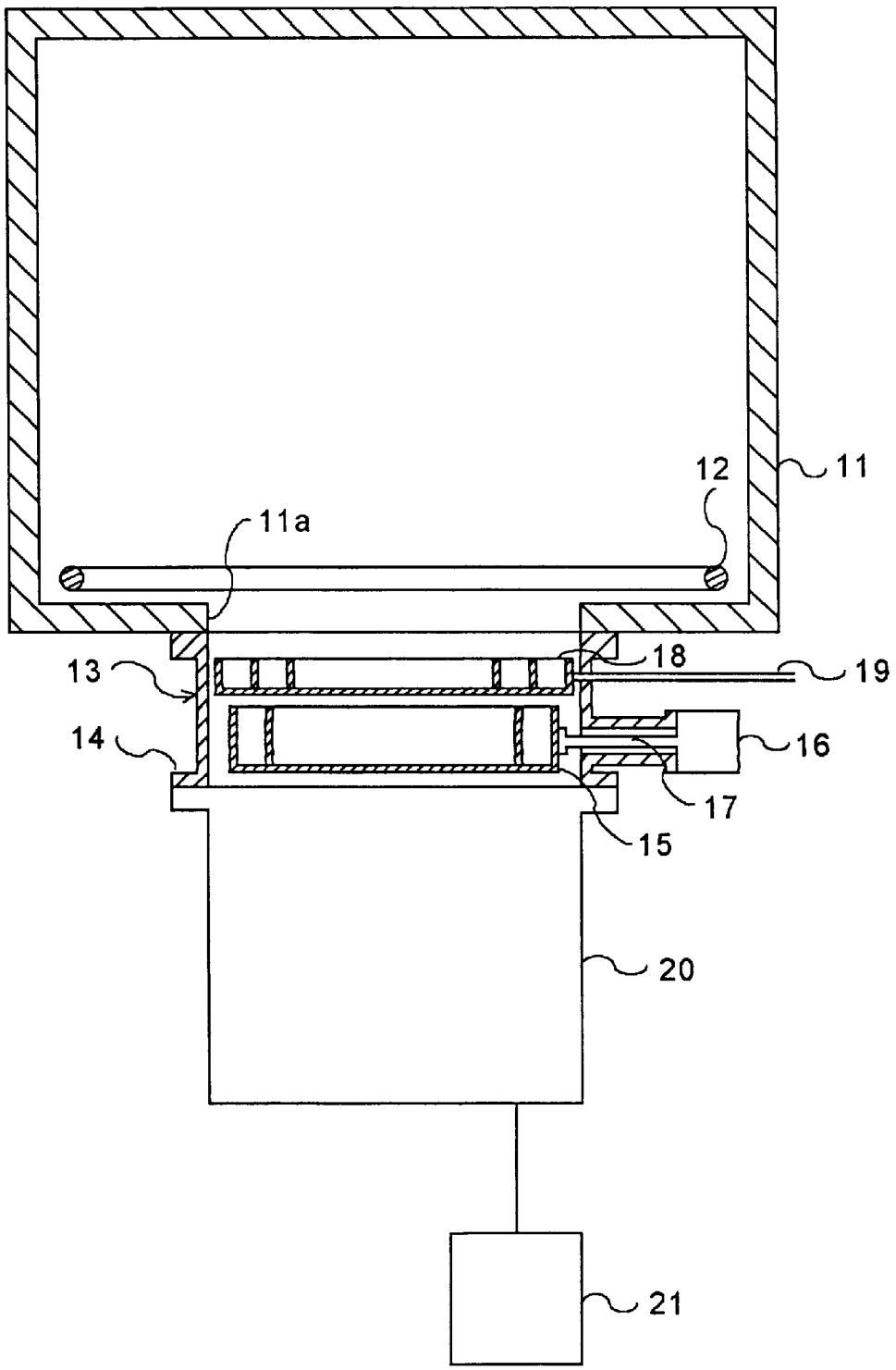
FIG. 1 is a part vertical cross-sectional drawing which shows an embodiment of the invention.
Figure 2:
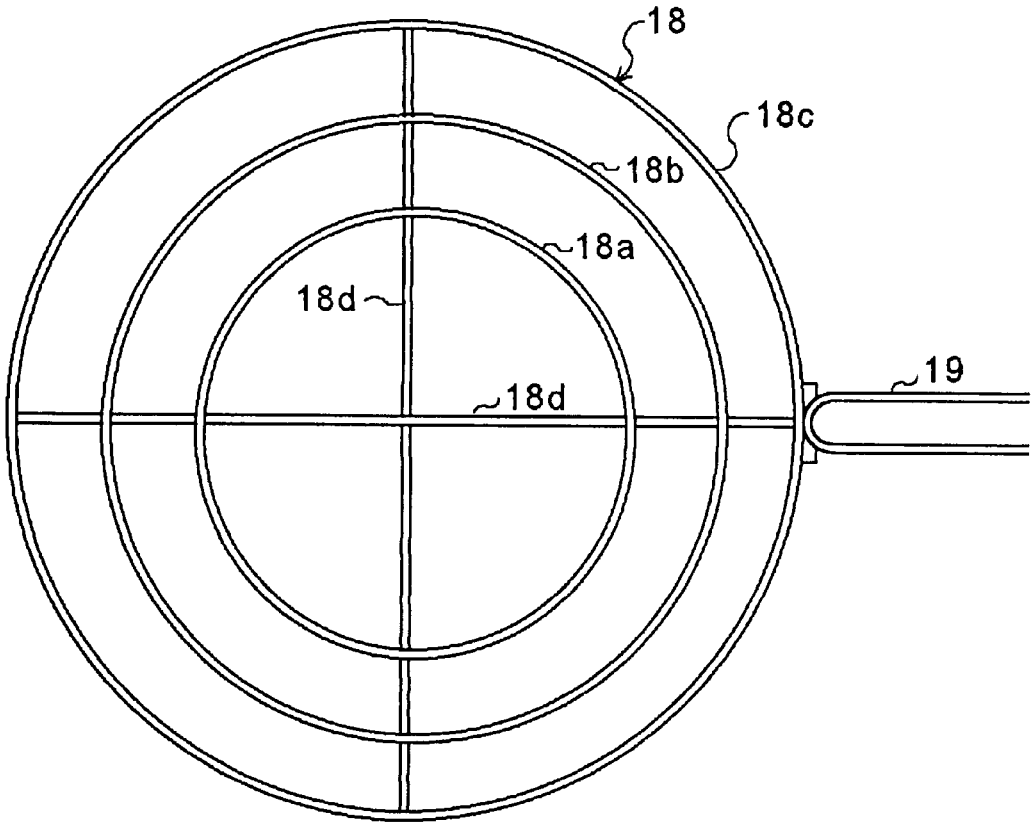
FIG. 2 is a plan view of a radiant heat absorbing baffle.
Figure 3:
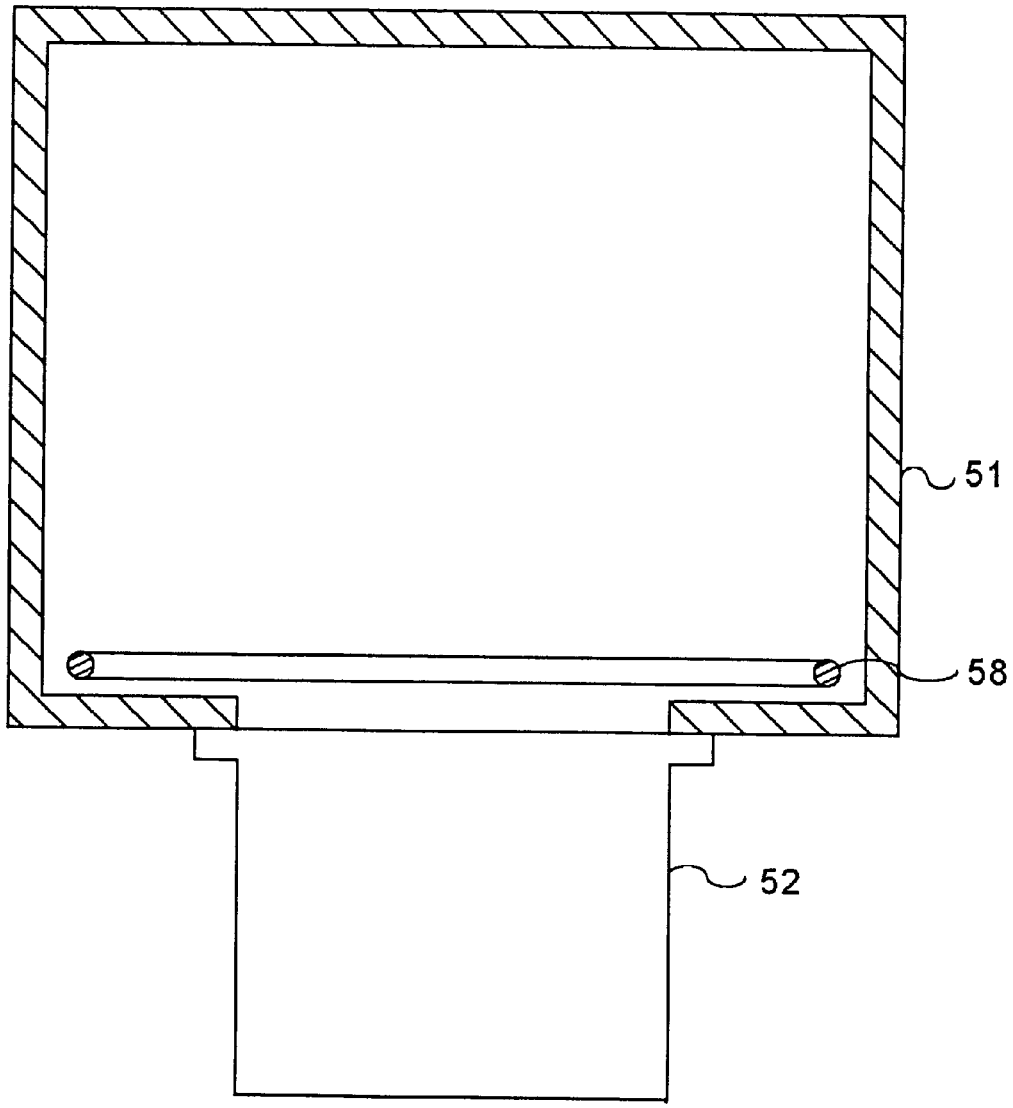
Prior Art Fig.3
FIG. 3 is a part vertical cross-sectional drawing which shows a first example of a conventional cryogenic vacuum pump system.
Figure 4:
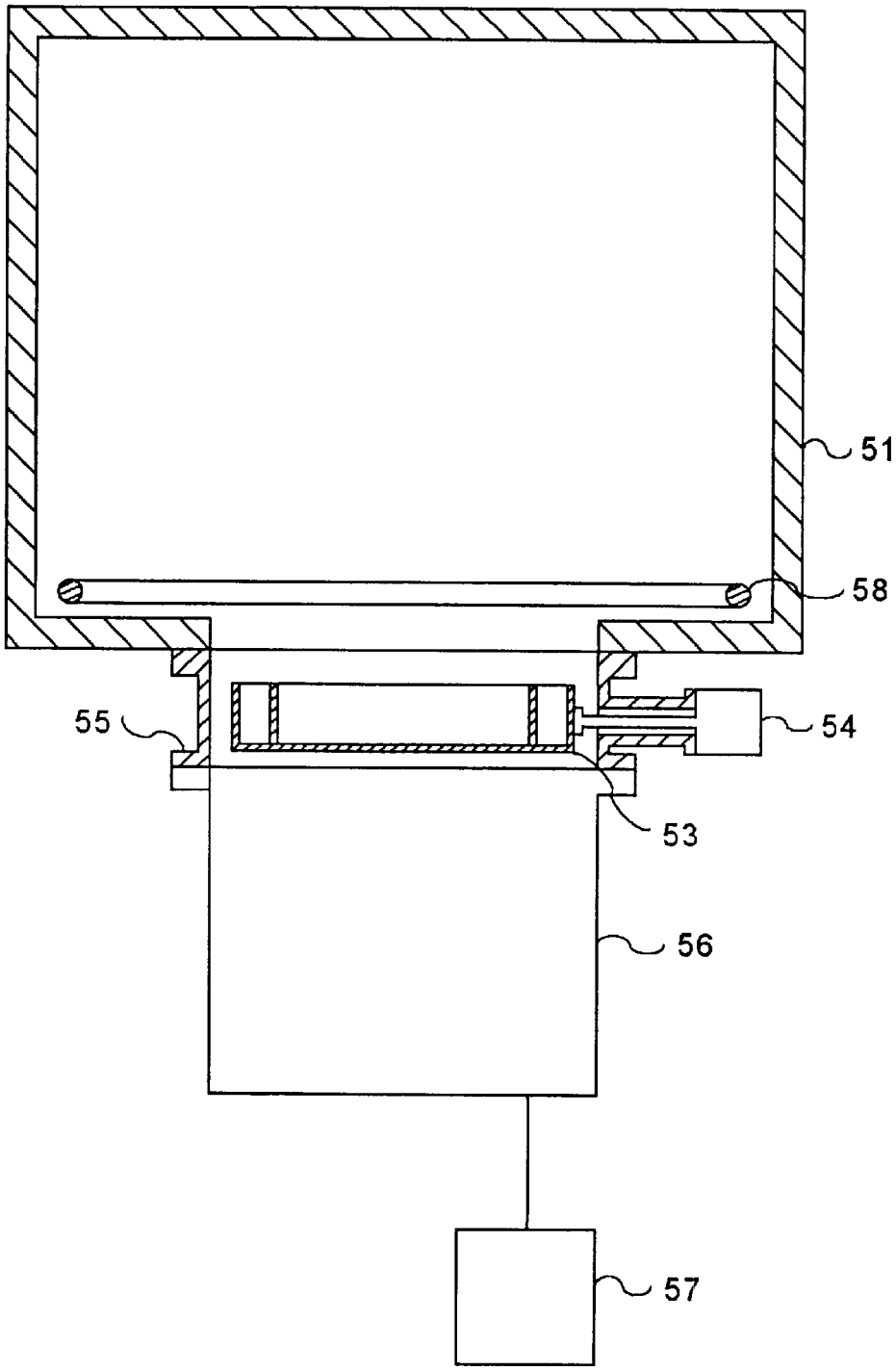
Prior Art Fig.4
FIG. 4 is a part vertical cross-sectional drawing which shows a second example of a conventional cryogenic vacuum pump system.
Figure 5:
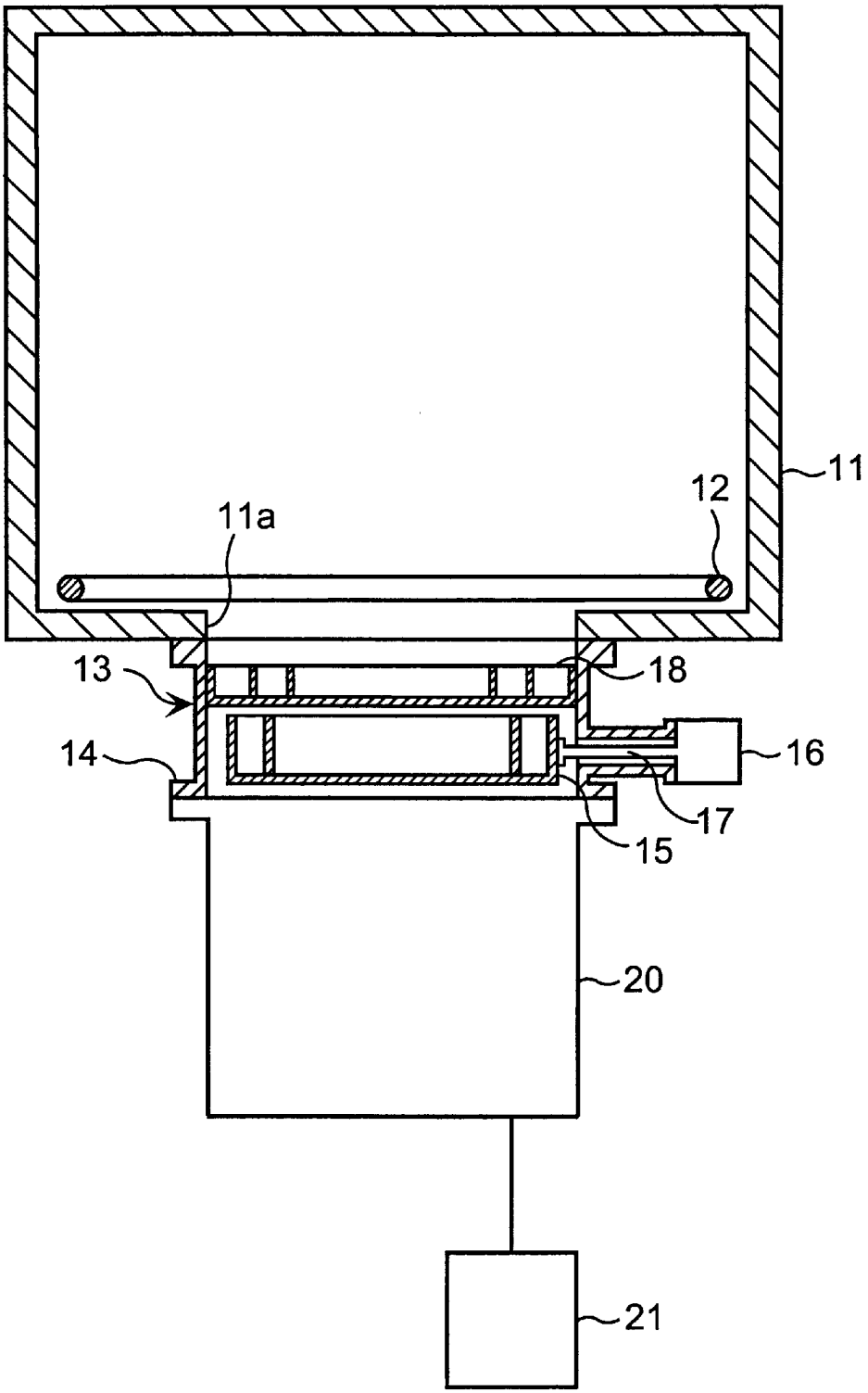
FIG. 5 is a view of an alternative embodiment that is substantially the same as FIG. 1, except that the cryopanel is connected to the chamber with good thermal contact.

An outline cross-sectional drawing of one embodiment of a cryogenic vacuum pump system of the present invention is shown in FIG. 1, and a plan view of the radiant heat absorbing baffle is shown in FIG. 2. The cryogenic vacuum pump system of this embodiment has a water cooled type radiant heat absorbing baffle 18 fitted to the cryotrap 13 which, in the main, selectively removes water.

In FIG. 1, the chamber 11 is being subjected to vacuum pump out. The heating body 12, for example a heater, is arranged inside the chamber 11 close to the opening 11*a* in the bottom wall of the chamber 11, and the cryotrap 13 is fitted on the outside of the opening 11*a*. The cryotrap 13 comprises a cylindrical chamber 14, a cryopanel 15, a radiant heat absorbing panel 18 and a cryogenic refrigerator 16. The cylindrical chamber 14 is made with a greater axial length than a conventional cylindrical chamber in order to accommodate the radiant heat absorbing baffle 18 and the cryopanel 15.

The radiant heat absorbing baffle 18 is arranged at a location within the cylindrical chamber 14 above the cryopanel 15. Hence, the radiant heat absorbing baffle 18 is arranged between the above mentioned heating body 12 and the cryopanel 15. The radiant heat absorbing baffle 18 is arranged on the upstream side of the cryopanel 15 in terms of the flow of gas which is being pumped out. In this embodiment, the radiant heat absorbing baffle 18 is connected to a cooling water pipe 19 for cooling purposes.

A cryogenic refrigerator 16 is arranged outside the cylindrical chamber 14. The cryogenic refrigerator 16 is connected to the cryopanel 15 inside the cylindrical chamber 14 via a thermal conductor 17. The cryogenic panel 15 is cooled to a prescribed very low temperature by the cryogenic refrigerator 16.

A turbo-molecular pump 20 is fitted below the cryotrap 13, and an auxiliary pump 21, for example a mechanical vacuum pump, is also provided.

The radiant heat absorbing baffle 18 comprises the three circular radiant heat absorbing baffles 18*a* to 18*c* which are arranged concentrically, and two supports 18*d* which intersect in the form of a cross, as shown in FIG. 2. The supports 18*d* support the radiant heat absorbing baffles 18*a* to 18*c* concentrically and make connections which have good thermal conductivity between the radiant heat absorbing baffles. The outside radiant heat absorbing baffle 18*c* is connected in a way which provides good thermal conduction to the aforementioned water cooling pipe 19. The water cooling pipe 19 has the effect of releasing externally the heat which has been absorbed from the radiant heat absorbing baffles 18 by means of a flow of cooling water which is supplied from outside.

The radiant heat absorbing baffle 18 is preferably made from sheet material, such as copper or aluminum, which has good thermal conductivity, and the surface is preferably subjected to a blackening surface treatment, such as black chrome plating. Black chrome plating provides an infrared radiation absorbance of from 92 to 98% and an emissivity of from 0.066 to 0.12%, and so it is a good absorber of infrared radiation and also has the characteristics of allowing virtually no re-irradiation. The infrared radiation which has been radiated from the heating body 12 and reflected by the inner surface of the walls of the chamber 11 is absorbed with a high probability by the radiant heat absorbing baffle 18, which has been black chrome plated.

As shown in FIG. 1, the radiant heat absorbing baffle 18 is arranged on the chamber 11 side with respect to the cryopanel 15 inside the cylindrical chamber 14 of the cryotrap 13. The infrared radiation which radiates into the cylindrical chamber 14 from the chamber 11 reaches the radiant heat absorbing baffle, whereupon said baffle absorbs with a high probability the infrared radiation which reaches said baffle, and the heat which is absorbed is released to the outside of the cryotrap 13 by the water cooling pipe 19. The radiant heat absorbing baffle 18 interrupts the radiant heat (infrared radiation) originating from the heating body 12 which is being radiated onto the cryopanel 15. The radiant heat absorbing baffle 18 greatly reduces the thermal load which is imposed on the cryopanel 15. Hence, it is possible to use a cryogenic refrigerator 16 for the cryopanel which has a relatively small cooling capacity when compared with a conventional system.

It has been confirmed by experiment that when the radiant heat absorbing baffle 18 and the cryopanel 15 are almost the same size in the embodiment described above, it is possible to absorb by means of the radiant heat absorbing baffle 18 some 70 to 90% of the infrared radiation which is being radiated onto the cryopanel 15.

In the embodiment described above, the radiant heat absorbing baffle 18 and the cryopanel 15 are housed in the same cylindrical chamber 14, but it is clear that the same radiant heat absorbing effect as described above can be achieved even if they are housed in separate chambers. In those cases where a cryopump is used, it is, of course, possible to realize the same radiant heat absorbing effect as described above by establishing a radiant heat absorbing baffle between the cryopump and the chamber which is to be subjected to vacuum pump out.

The radiant heat absorbing baffle cooling system may involve the use of a cooling fluid other than water, or a semiconductor heat exchange type cooling element such as a Peltier element.

In another embodiment, the radiant heat absorbing baffle 18 is fitted directly with good thermal contact to the chamber 11 where the chamber 11 which is to be subjected to vacuum pump out is made of a material which has good thermal conductivity, such as aluminum. In this case, even though no water cooling system is being used, the heat which is absorbed by the radiant heat absorbing baffle 18 is released outside the chamber 11 as a result of being conducted into the chamber 11, and the heat is exchanged with the atmosphere through the walls of the chamber 11. The radiant heat absorbing baffle 18 may be formed as one with the body of the chamber 11. In this case, the absorption of the infrared radiation is enhanced by subjecting the inner surface of the walls of the chamber 11 to black chrome plating.

Moreover, in another embodiment, in those cases where the amount of infrared radiation produced inside the chamber 11 is comparatively small, a blackening surface treatment which facilitates the absorption of infrared radiation is carried out on the inner surface of the cylindrical chamber 14 in which the cryopanel 15 is housed. As a result, a radiant heat absorbing part which has been formed by a blackening surface treatment is established around the cryopanel 15. Of the radiant heat which is directed toward the cryopanel 15, a considerable amount (90% or more) is absorbed by said radiant heat absorbing part. The thermal load on the cryopanel 15 is greatly reduced as a result of this. There is no need to use a radiant heat absorbing baffle which shields the cryopanel 15 from the infrared radiation in this embodiment. Moreover, the cryopanel 15 is preferably subjected to a surface treatment which reduces its heat absorbing characteristics, such as lustrous nickel plating for example. The construction is comparatively simple since it can be realized by simply carrying out a blackening surface treatment on the inner surface of the cylindrical chamber (nipple) of a conventional apparatus, which is to say a conventional cryogenic vacuum pump. Moreover, the above mentioned radiant heat absorbing part is not limited to the inner surface of the cylindrical chamber 14 and, of course, other analogous parts can be used.

What is claimed is:

1. A cryogenic vacuum pump system, comprising:

a cryogenic refrigerator.

a cryopanel which is cooled by the cryogenic refrigerator, and a noncryogenic radiant heat absorbing unit which is arranged on an upstream side of the cryopanel in a direction of flow of gas which is being pumped out.

2. The cryogenic vacuum pump system as claimed in claim 1, wherein the radiant heat absorbing unit is a baffle.

3. The cryogenic vacuum pump system, as claimed in claim 2, wherein the baffle is made of a metal.

4. The cryogenic vacuum pump system as claimed in claim 2, wherein a surface of the baffle has a blackening surface treatment.

5. The cryogenic vacuum pump system as claimed in claim 2, wherein the blackening surface treatment is black chrome plating.

6. The cryogenic vacuum pump system as claimed in claim 1, wherein the radiant heat absorbing unit is water cooled and is arranged downstream of a vacuum chamber that is subjected to vacuum pump out.

7. The cryogenic vacuum pump system as claimed in claim 1, wherein the radiant heat absorbing unit is cooled with a heat exchange element.

8. The cryogenic vacuum pump system as claimed in claim 1, wherein the cryopanel is cooled to a temperature at which gases in the system condense.

9. The cryogenic vacuum pump system as claimed in claim 1, wherein the cryopanel and the radiant heat absorbing unit are mounted in a cryotrap that is mounted between a vacuum chamber and a pump.

10. A cryogenic vacuum pump system, comprising:

a chamber which is subjected to vacuum pump out, a cryopanel, and a noncryogenic radiant heat absorbing unit which is arranged upstream of the cryopanel in a direction of the flow of gas which is being pumped out and which is connected to the chamber such that thermal energy is transferred from the radiant heat absorbing unit to the chamber.

11. The cryogenic vacuum pump system as claimed in claim 10, wherein the radiant heat absorbing unit is formed as one with the chamber, and an inside wall surface of the chamber is subjected to a blackening surface treatment.

12. The cryogenic vacuum pump system as claimed in claim 10, wherein the cryopanel and the radiant heat absorbing unit are mounted in a cryotrap that is mounted between a vacuum chamber and a pump.

13. A cryogenic vacuum pump system, comprising:

a cryotrap having a noncryogenic interior surface, a cryopanel located within the cryotrap, and the noncryogenic interior surface surrounding the cryopanel has a blackening surface treatment to function as a radiant heat absorbing unit.

14. The cryogenic vacuum pump system as claimed in claim 13, wherein the radiant heat absorbing unit is an inner surface of a chamber in which the cryopanel is fitted.

15. The cryogenic vacuum pump system as claimed in claim 13, wherein the blackening surface treatment is black chrome plating.

16. The cryogenic vacuum pump system as claimed in claim 13, wherein the interior surface that has been subjected to the blackening surface treatment completely encircles the cryopanel.

17. The cryogenic vacuum pump system as claimed in claim 13, wherein the cryopanel is subjected to a surface treatment which reduces its ability to absorb thermal energy.

18. The cryogenic vacuum pump system as claimed in claim 17, wherein the surface treatment is lustrous nickel plating.

19. A cryotrap for use between a vacuum chamber and a pump, the cryotrap comprising:

first means at a first end of the cryotrap for connecting the cryotrap to the vacuum chamber;

second means at a second end of the cryotrap for connecting the cryotrap to the pump;

a noncryogenic radiant heat absorbing unit located in the cryotrap at the first end of the cryotrap; and a cryopanel located in the cryotrap at the second end of the cryotrap.

20. The cryotrap of claim 19, wherein the cryotrap is substantially cylindrical and the first and second connecting means include flanges mounted at respective ends of the cryotrap.

* * * * *